US006967444B2

(12) United States Patent
Callahan et al.

(10) Patent No.: US 6,967,444 B2
(45) Date of Patent: Nov. 22, 2005

(54) MINIATURE REDUCED MERCURY HID LAMP

(75) Inventors: Susan L. Callahan, Peterborough, NH (US); Walter P. Lapatovich, Boxford, MA (US)

(73) Assignee: Osram Sylvania Inc., Danvers, MA (US)

( * ) Notice: Subject to any disclaimer, the term of this patent is extended or adjusted under 35 U.S.C. 154(b) by 11 days.

(21) Appl. No.: 10/840,483

(22) Filed: May 6, 2004

(65) Prior Publication Data

US 2005/0168150 A1 Aug. 4, 2005

Related U.S. Application Data

(60) Provisional application No. 60/540,038, filed on Jan. 29, 2004.

(51) Int. Cl.[7] ..... H01J 17/20

(52) U.S. Cl. ..... 313/637; 313/638; 313/639; 313/640

(58) Field of Search ..... 313/637–643, 313/573, 25, 26, 17

(56) References Cited

U.S. PATENT DOCUMENTS

| | | | | |
|---|---|---|---|---|
| 6,456,008 | B1 * | 9/2002 | Fukuyo et al. | 313/638 |
| 6,853,140 | B2 * | 2/2005 | Lapatovich et al. | 313/637 |
| 2002/0027421 | A1 * | 3/2002 | Kaneko et al. | 313/637 |
| 2003/0052610 | A1 * | 3/2003 | Takagaki et al. | 313/637 |
| 2003/0189408 | A1 * | 10/2003 | Lapatovich et al. | 313/637 |
| 2004/0004438 | A1 * | 1/2004 | Deguchi et al. | 313/637 |

* cited by examiner

*Primary Examiner*—Joseph Williams
*Assistant Examiner*—Peter Macchiarolo
(74) *Attorney, Agent, or Firm*—William E. Meyer

(57) ABSTRACT

Superior color stability in a miniature HID lamp can be achieved by reducing the size of the lamp, reducing the mercury concentration, reducing the salt concentration and increasing the heat to the lamp seal. In general the result concentrates the salts in the central, lower section of the lamp envelope and displaces them from the hot spot and electrode roots were deleterious chemical reactions can occur that are believed to subsequently reduce lamp performance.

16 Claims, 1 Drawing Sheet

MINIATURE REDUCED MERCURY HID LAMP

CROSS-REFERENCE TO RELATED APPLICATIONS

The Applicants hereby claim the benefit of their provisional application Ser. No. 60/540,038 filed Jan. 29, 2004 for MINIATURE REDUCED MERCURY HID LAMP.

BACKGROUND OF THE INVENTION

1. Field of the Invention

The invention relates to electric lamps and particularly to high intensity discharge lamps. More particularly the invention is concerned with reduced mercury, miniature high intensity discharge lamp.

2. Description of the Related Art Including Information Disclosed Under 37 CFR 1.97 and 1.98

The use of low wattage, high intensity discharge lamps for automotive forward lighting is well established. All of the major lighting companies have products on the market. These types of lamps have been used in the automotive market for a number of years and offer more light on the road for improved nighttime visibility. Most of these lamps contain mercury in small amounts, although there has been considerable effort to develop mercury-free versions.

In most cases, miniature HID lamps perform well over the expected life of about 2500 hours. However, because of the small volume and high power loading, the interior of the lamp vessel is quite hot and physiochemical reactions that affect the virgin lamp performance are accelerated. As a result, the color of the lamp may shift over time. Regulations require the color initially to be within the SAE or ECE defined white areas; nonetheless the chromaticity coordinates may shift over the lamp's life due to chemical reactions within the lamp volume. Color shift is a major concern of vehicle manufacturers and their customers. Customers prefer a minimal color shift; a slow color shift and a color shift such that neither the x nor the y color coordinates go below 0.360 within the first 1500 hours of lamp operation. Of course, the lamp arc gap and operating voltage must be the same for optical considerations and the lamp must function properly on existing electronic control gear. There is then a need for a miniature automotive HID lamp with increased color stability, voltage stability, and lumen maintenance. There is a similar need for such a lamp with increased lamp life. The present invention addresses the color shift of the light output from the automotive headlamp as the lamp ages.

BRIEF SUMMARY OF THE INVENTION

A miniature HID lamp may be made with a light transmissive inner envelope having a wall defining an axially extended enclosed volume, a first seal and a second seal; the enclosed volume having a volume of less than 22 cubic millimeters. The lamp includes a first electrode assembly having an exterior end and a first electrode tip, the first electrode assembly being sealed in the first seal and extending between the exterior and the enclosed volume; and a second electrode assembly having an exterior end and a second electrode tip, the second electrode assembly being sealed in the second seal and extending between the exterior and the enclosed volume, with the first tip nominally offset from the second tip by a predefined gap distance. The lamp has a fill enclosed in the defined volume including mercury at a concentration of less than 0.02 milligrams per cubic millimeter, metal halide salts at a concentration of less than 0.02 milligrams per cubic millimeter and xenon at a cold pressure of from $4\times10^5$ to $16\times10^5$ Pascals; the fill being excitable to light emission on the application of sufficient electric power between the first electrode and second electrode. The lamp further includes a light transmissive jacket surrounding the inner envelope and sealed to the inner envelope along the first seal and the second seal, the jacket being formed from a material with a light absorbing component to thereby be heated by a portion of light emission from fill material, and sufficiently thermally conductive to conduct a portion of such heat to the envelope seals.

It is an object of the present invention to achieve a lamp such that the color shift over life, characterized by chromaticity trajectory (the temporal locus of x, y points in C.I.E. 1931 chromaticity diagram): wherein the x and y chromaticity coordinates each remain greater than 0.360, and the x and y chromaticity coordinates remain in the ECE "white" definition box.

It is a further object of the present invention to achieve nominal operating voltage of 85 (+/−17) volts.

It is an additional objective of the present invention to achieve good lumen maintenance relative to existing products.

DETAILED DESCRIPTION OF THE INVENTION

Figure 1:
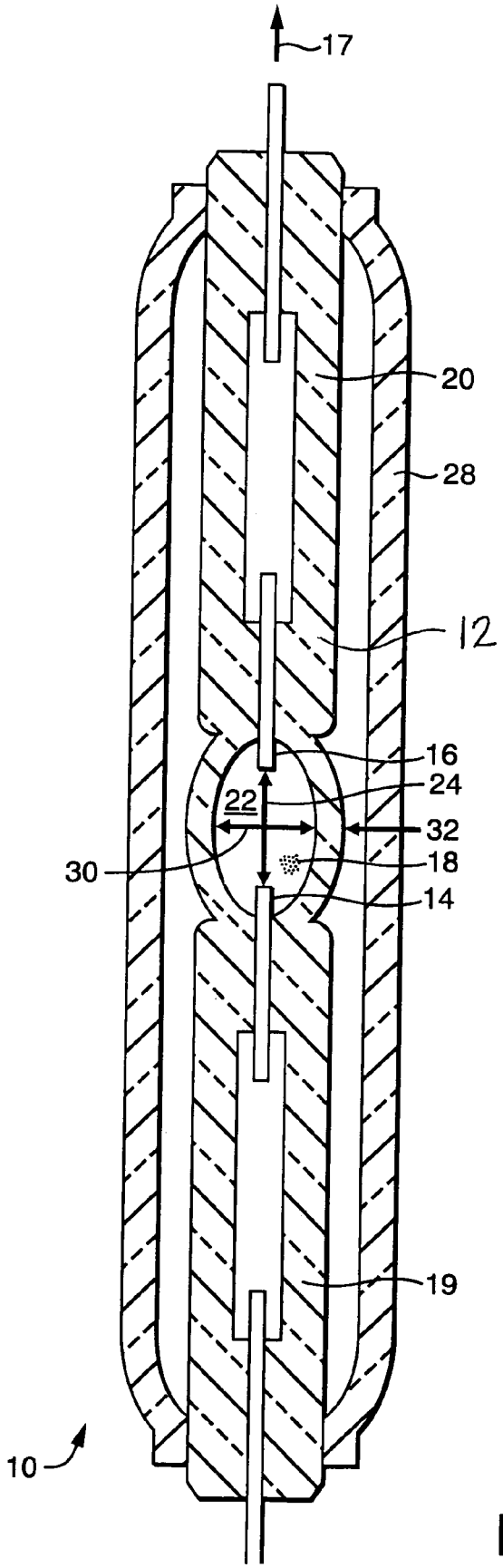
FIG. 1 shows a schematic, cross sectional view of an automotive high intensity discharge lamp.

An automotive discharge lamp 10 of the type being considered here comprises an inner envelope 12, two electrodes 14, 16, a fill material 18 and an outer jacket 28. The preferred inner envelope 12 is formed from a light transmissive tube, such as a vitreous silica, also known as quartz, having an inside diameter of about 3.0 mm, and outside diameter of about 6.0 mm. The tube is shaped to define a bulbous interior 22 with a volume of about 20 $mm^3$ that is preferably rotationally symmetric about the tube axis 17. Two electrodes 14, 16 are press sealed 19, 20 in the axial ends of the envelope 12 to have a proper gap 24, as is known in the art. The preferred electrodes include tungsten inner tips, molybdenum intermediate foils and molybdenum outer leads. The enclosed volume 22 includes a fill material 18 that is excitable to light emission on the application of sufficient electric power between the electrodes 14, 16, as is known in the art. The preferred fill 18 provides a white light falling in the defined SAE or ECE restricted white areas, such as a sodium iodide, scandium iodide mixture of 6:1 or greater molar ratio. Other fill materials are known in the art. Surrounding the inner envelope 12 and sealed to the press seals 19, 20 or to the ends of the envelope 12 is an outer jacket 28. The preferred outer jacket 28 in generally transmits visible light, but may also be formulated to intercept possibly harmful ultraviolet light. The preferred jacket material includes a radiant energy intercepting component, such as an infrared intercepting component to be thereby heated by the radiant emission from the inner envelope 12 and the fill material 18. The envelope 12 and the outer jacket 28 are otherwise offset one from the other to define an intermediate volume. The lamp 10 may be supported in a base, numerous examples of which are known in the art. The lamp 10 is designed to have a normal operating voltage of 85 volts (+/−17 volts).

A novel feature of the present invention is an unobvious, and counter-intuitive, approach to achieve color stability. Color stability is achieved by reducing the interior lamp volume. Intuitively, a smaller lamp volume, with the same electrical input should cause the lamp to overheat (since wattage is maintained at 35 watts, the power loading is thus increased). This should speed deleterious chemical reactions leading to terrible color control and reduced lamp life. However, this has been found not to occur if the interrelationships between the physiochemical processes are exploited.

The interior volume is reduced by narrowing the inner diameter 30 of a standard lamp from about 2.7 mm to about 2.45 mm. This results in about a 20% volume reduction from conventional lamp with a nominally volume of 25 $mm^3$ to about 20 $mm^3$. The preferred reduced volume is otherwise in the range of from 15 $mm^3$ to 22 $mm^3$ The arc gap 24 is maintained at the nominally required 4.2 mm to meet optical requirements. When the volume is reduced in this fashion, the inner envelope wall 32 is thicker, since the approximately 6.0 mm outside diameter is constant. The thicker wall permits a more even distribution of heat through the envelope wall.

The mercury content is also reduced, so the voltage is kept in the nominal range of 85 volts (+/−17) volts. This is an environmentally beneficial feature of the invention. The mercury dose is reduced from a standard 0.55 mg to a range of about 0.20 mg to 0.40 mg. This reduces the mercury fill concentration from the usual level of about 0.022 mg per $mm^3$ to a fill concentration of about 0.01 to 0.02 mg per $mm^3$. The preferred mercury fill is 0.35 mg leading to a mercury concentration of about 0.0175 mg per $mm^3$. This is a mercury concentration reduction of about 20 percent. Reduced mercury concentration means reduced operating pressure (since the mercury charge is completely vaporized). This reduces the arc buoyancy force, reducing the upward bow in the arc. Similarly, the wall temperature is reduced along the upper portion of the envelope. Tests have shown the outer surface temperature along the top wall is reduced in the improved lamp; indicating the corresponding upper, inner wall temperature has also been reduced. This means the arc is moved away from the upper surface. The reduction in upper inner arc tube temperature reduces the rate of chemical reaction within the arc tube and leads to a more stable lamp chemistry and therefore a more stable lamp color.

The third improvement in thermal management is made by replacing the jacket material. Normally the jacket material is quartz doped for absorbing ultraviolet light. The new outer jacket material has a greater infrared absorption. Specifically, the preferred outer envelope material has an infrared absorption about 15 percent greater than that of quartz in the spectral region greater than 3 microns, due to the greater hydroxyl concentration in the glass. This glass (Vycor® 7907) is believed to have a formulation of approximately 0.62% $CeO_2$; 3 ppm BaO; 0.16% $ZrO_2$; 2.60% $B_2O_3$; 0.52% $Al_2O_3$; 10.2 ppm $Na_2O$; 36 ppm CaO; 1.1 ppm $K_2O$ and the rest being silica. The particular glass formulation is not important. It is only important that glass convert some of the radiation to heat the seals a small amount. The optical characteristics of the preferred glass (Vycor® 7907) sleeve permits absorption of the ultraviolet radiation, and more absorption of the infrared radiation from the hot arc tube. As a result the jacket 28 is heated somewhat more and that increased heat is conducted through the jacket 28 into the press area 19, 20 of the lamp envelope 12. The press seal areas 19, 20 are then heated, and preferably heated to be isothermal or slightly hotter than at least the adjacent wall regions of the inner envelope 12. Again, this is counter-intuitive and novel. Heating the seals 19, 20 is generally avoided as it causes the seals to fail sooner. Here, the additional heat elevates the press temperature about 40° C., thereby preventing other fill components, such as sodium/scandium iodide (salts), from creeping into the electrode root and the seal area. The melt pool of salts is then largely confined to the lower half of the envelope interior. It is desirable to localize the melt away from the seals in this way to inhibit deleterious chemical reactions, which foster leaks in that area. It is further desirable to limit these reactions since they contribute to melt changes, which alter the color of the lamp.

The fourth improvement is the modification of the chemical doses. Lamps were made according to the principles outlined above and had dimensions of outside diameter of 6.0 mm, inside diameter of 2.45 mm, arc gap of 4.2 mm, cold fill (20 degrees Celsius) Xenon of between $4\times10^5$ to $16\times10^5$ Pascals (4 to 16 atmospheres) with a preferred pressure value of $8\times10^5$ Pascals (8 atmospheres), and a metal halide salt of 0.210 mg to about 0.315 mg. This gives a salt concentration of from about 0.0105 mg/$mm^3$ to about 0.01575 mg/$mm^3$. The preferred salt concentration is from about 0.01 mg/$mm^3$ to about 0.02 mg/$mm^3$. The preferred metal halide salt composition is a Sodium Scandium iodide of 7:1 molar ratio or by weight percent NaI 71.2% and $SCI_3$ 28.8%. This is an increase from the usual molar ratio of 6:1 that is currently used in production lamps. As mentioned above the mercury is reduced from about 0.55 mg to between 0.20 to 0.40 mg with the preferred value being 0.35 mg of mercury. This reduces the mercury concentration from about 0.022 mg/$mm^3$ to 0.0175 mg/$mm^3$, a 20 percent reduction in mercury concentration.

The arc lamp is fabricated using techniques known to those skilled in the art. The vitreous silica (quartz) is preformed, molybdenum foils are welded to tungsten electrodes and exterior molybdenum lead wires are attached. One press seal is then made. The lamp is filled with salts, mercury and xenon gas and then the second press seal is made. The lamp is jacketed in the infrared absorbing glass (Vycor® 7907) and mounted in headlamp base with electrical connections to an outside power source, to provide a mechanically sound construction typical of HID headlamps, and of particular geometry to mate with electrical connectors originating in the electronic control gear.

It was an unanticipated benefit of the present invention with the prescribed chemistry that the time derivative of lamp voltage is retarded compared with prior lamp products. The lamp voltage is thus more stable. This is now felt to be the result of the reduction in chemical reactions. As normal chemical reactions proceed in the lamp, iodine is liberated, which eventually forms mercury iodide. A build up of this mercury iodide is a contributing factor to higher operating voltage. Thus the reduced chemical reaction rates contribute to good voltage and color stability and lumen maintenance.

As a result, one set of prior D2S lamps (25 $mm^3$, 0.55 mg mercury, quartz jacket, etc.) had x and y color coordinated value shifts of 0.025, 0.028 while remaining just inside the edge of the restricted white area. The improved D2S lamps (20 $mm^3$, 0.35 mg mercury, infrared absorbing jacket (Vycor® 7907), etc.) had x and y color coordinate shifts of 0.018, 0.018 and were closer to the center of the restricted white area. This was a 28% reduction in the CCX and a 36% reduction in the CCY color shift. The prior D2S lamps had a lumen maintenance of about 73% at 1500 hours. The improved D2S lamps had a lumen maintenance of about 82% at 1500 hours or a 15% improvement in light output (absolute lumens) after 1500 hours. The prior D2S lamps had a voltage maintenance with an increase of 19%. The improved D2S lamps showed an improved voltage increase of only 17%.

In a similar result, one set of prior D2R lamps (25 $mm^3$, 0.55 mg mercury, quartz jacket, etc.) had color shifts of 0.022, 0.028 while remaining just inside the edge of the restricted white area. The improved D2R lamps (20 $mm^3$, 0.35 mg mercury, Infra red absorbing glass (Vycor® 7907) jacket, etc.) had color shifts of 0.015, 0.022 and were closer to the center of the restricted white area. This was a 32% reduction in the CCX and a 21% reduction in the CCY color shift. The prior D2R lamps had a lumen maintenance of about 68% at 1500 hours. The improved D2R lamps had a lumen maintenance of about 75% at 1500 hours or a 7% improvement in light output (absolute lumens) after 1500 hours.

The present invention is superior in terms of voltage stability, color stability and lumen output. All of these lamp technical properties are linked to the chemical reactions within the arc tube. The present invention reduces the chemical reactions through careful system thermal management with tight controls on the lamp dimension and chemical doses. The importance of the present invention is clear. It provides a better automotive HID headlamp, containing less mercury, and having superior color stability to existing products. It is an added and desirable feature of the present invention that it is an environmentally friendly or reduced-mercury content lamp. It is believed that because of the reduction in the deleterious chemical reactions, lamp life of these lamps should also be increased. While there have been shown and described what are at present considered to be the preferred embodiments of the invention, it will be apparent to those skilled in the art that various changes and modifications can be made herein without departing from the scope of the invention defined by the appended claims.

What is claimed is:

1. A miniature HID lamp comprising: a light transmissive inner envelope having a wall defining an axially extended enclosed volume, a first seal and a second seal; the enclosed volume having a volume of less than 22 cubic millimeters; a first electrode assembly having an exterior end and a first electrode tip, the first electrode assembly being sealed in the first seal and extending between the exterior and the enclosed volume; a second electrode assembly having an exterior end and a second electrode tip, the second electrode assembly being sealed in the second seal and extending between the exterior and the enclosed volume, with the first tip nominally offset from the second tip by a predefined gap distance; a lamp fill enclosed in the defined volume including mercury at a concentration of less than 0.02 milligrams per cubic millimeter, metal halide salts at a concentration of less than 0.02 milligrams per cubic millimeter and xenon at a cold pressure of from $4\times10^5$ to $16\times10^5$ Pascals; the fill being excitable to light emission on the application of sufficient electric power between the first electrode and second electrode; and a light transmissive jacket surrounding the inner envelope and sealed to the inner envelope along the first seal and the second seal, the jacket being formed from a material with a light absorbing component to thereby be heated by a portion of light emission from fill material, and sufficiently thermally conductive to conduct a portion of such heat to the envelope seals; wherein the lamp fill includes from 0.20 milligrams to 0.40 milligrams of mercury.

2. The lamp in claim 1, wherein the lamp fill includes about 0.35 milligrams of mercury.

3. The lamp in claim 1, wherein the lamp has mercury fill concentration from about 0.01 mg per $mm^3$ to about 0.02 mg per $mm^3$.

4. The lamp in claim 3, wherein the lamp has mercury fill concentration of about 0.0175 mg per $mm^3$.

5. The lamp in claim 3, wherein the lamp fill includes sodium iodide and scandium iodide in a molar ratio of approximately 7:1.

6. The lamp in claim 1, wherein the lamp fill includes sodium iodide and scandium iodide in a molar ratio of greater 6:1 and less then 8:1.

7. The lamp in claim 1, wherein the lamp fill includes from 0.2 to 0.4 milligrams sodium and scandium iodide.

8. The lamp in claim 1, wherein the lamp has salt concentration from about 0.01 mg per $mm^3$ to about 0.02 mg per $mm^3$.

9. The lamp in claim 7, wherein the lamp has salt concentration of about 0.01575 mg per $mm^3$.

10. The lamp in claim 1, wherein the jacket is composed of a material with a greater absorbency of radiant energy than that of quartz at least in the region greater than 3 microns.

11. The lamp in claim 9, wherein the jacket is formed from a material, and has such size and dimension to conduct sufficient heat to the first seal and the second seal such that the inner envelope operates with a substantially isothermal wall condition.

12. The lamp in claim 9, wherein the jacket is formed from a material, and has such size and dimension to conduct sufficient heat to the first seal and the second seal such that the first seal and the second seal operate at temperatures at or above the temperatures of portions of the inner envelope wall adjacent respectively the first seal and the second seal.

13. The lamp of claim 1, wherein the mercury fill concentration is less than 0.02 mg per $mm^3$.

14. The lamp in claim 1 wherein the fill includes Xenon with a cold fill pressure from $4\times10^5$ to $16\times10^5$ Pascals.

15. A method of operating a miniature HID lamp comprising: a light transmissive inner envelope having a wall defining an axially extended enclosed volume, a first seal and a second seal; the enclosed volume having a volume of less than 22 cubic millimeters; a first electrode assembly having an exterior end and a first electrode tip, the first electrode assembly being sealed in the first seal and extending between the exterior and the enclosed volume; a second electrode assembly having an exterior end and a second electrode tip, the second electrode assembly being sealed in the second seal and extending between the exterior and the enclosed volume, with the first tip nominally offset from the second tip by a predefined distance; a lamp fill enclosed in the defined volume including mercury at a concentration of less than 0.02 milligrams per cubic millimeter, metal halide salts at a concentration of less than 0.02 milligrams per cubic millimeter and xenon at a cold pressure of from $4\times10^5$ to $16\times10^5$ Pascals; the fill being excitable to light emission on the application of sufficient electric power between the first electrode and second electrode; a light transmissive jacket surrounding the inner envelope and sealed to the inner envelope along the first seal and the second seal, the jacket being formed from a material with a radiant energy absorbance, at least in the spectral region greater than 3 microns, that is 15 percent or more greater than that of quartz; and supplying sufficient electric power between the electrodes to excite the fill material to light emission, such light including apportion of the type and of sufficient quantity absorbed by the jacket; to heat the jacket and thereby be heated the first seal and the second seal respectively to temperatures equal to or greater than respectively the temperatures of the envelope wall adjacent the first seal and the second seal; wherein the lamp fill includes from 0.20 milligrams to 0.40 milligrams of mercury.

16. A method of operating a miniature HID lamp comprising the steps of:

providing a lamp assembly having:

a light transmissive inner envelope having a wall defining an axially extended enclosed volume, a first seal and a second seal; the enclosed volume having a volume of less than 22 cubic millimeters;

a first electrode assembly having an exterior end and a first electrode tip, the first electrode assembly being sealed in the first seal and extending between the exterior and the enclosed volume;

a second electrode assembly having an exterior end and a second electrode tip, the second electrode assembly being sealed in the second seal and extending between the exterior and the enclosed volume, with the first tip nominally offset from the second tip by a predefined distance;

a lamp fill enclosed in the defined volume including mercury at a concentration of less than 0.02 milligrams per cubic millimeter, metal halide salts at a concentration of less than 0.02 milligrams per cubic millimeter and xenon at a cold pressure of from $4\times10^5$ to $16\times10^5$ Pascals; the fill being excitable to light emission on the application of sufficient electric power between the first electrode and second electrode; and a light transmissive jacket surrounding the inner envelope and sealed to the inner envelope along the first seal and the second seal, the jacket being formed from a material with a radiant energy absorbance, at least in the spectral region greater than 3 microns, that is 15 percent or more greater than that of quartz; and supplying sufficient electric power between the electrodes to excite the fill material to light emission, such light including a portion of the type and of sufficient quantity absorbed by the jacket; to heat the jacket and thereby be heated the first seal and the second seal respectively to temperatures equal to or greater than respectively the temperatures of the envelope wall adjacent the first seal and the second seal.

* * * * *